US006439911B1

(12) United States Patent
Conorich

(10) Patent No.: US 6,439,911 B1
(45) Date of Patent: Aug. 27, 2002

(54) CONTACTS FOR HINGED CONNECTION SYSTEM

(75) Inventor: Theodore A. Conorich, Lake Hiawatha, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/577,274

(22) Filed: May 23, 2000

(51) Int. Cl.[7] ..... H01R 4/50
(52) U.S. Cl. ..... 439/341; 439/676
(58) Field of Search ..... 439/341, 344, 439/350, 354, 357, 376, 676

(56) References Cited

U.S. PATENT DOCUMENTS 5,607,319 A * 3/1997 Wakata et al. ..... 439/341
5,683,267 A * 11/1997 Ribbeck et al. ..... 439/395

FOREIGN PATENT DOCUMENTS

DE 3634 695 A1 * 4/1988

* cited by examiner

*Primary Examiner*—Khiem Nguyen
(74) *Attorney, Agent, or Firm*—Gibbons, Del Deo, Dolan, Griffinger & Vecchione

(57) ABSTRACT

An electrical connection system for making patch cord connections that uses a hinged plug and jack mating system, wherein the system utilizes contact/engagement implementations that permit the plug and jack to mate on an arc. Specifically, blade and spring clip connectors are used that also result in low insertion forces and enhanced side to side stability for the patch cord connectors. The blade and spring clip connectors provide improved electrical performance and allow faster and more reliable connections. Moreover, a rotatable end structure is added adjacent to a jack cavity/engagement portion of a modular jack. A complementary rotatable end structure for the plug is also added. The plug is provided with curved engagement surfaces which permit the modular jack to mate in an arc with the plug.

15 Claims, 8 Drawing Sheets

CONTACTS FOR HINGED CONNECTION SYSTEM

RELATED APPLICATIONS

The present patent application is related to U.S. patent application Ser. No. 09/575,969, entitled, "HINGED CONNECTION SYSTEM", being concurrently filed herewith and having a filing date of May 23, 2000; U.S. patent application Ser. No. 09/575,968, entitled, "SLIDING CABLE FIXTURE", being concurrently filed herewith and having a filing date of May 23, 2000; to U.S. patent application Ser. No. 09/575,902, entitled, "CONNECTOR SYSTEM WITH RELEASABLE LATCH", being concurrently filed herewith and having a filing date of May 23, 2000; to U.S. patent application Ser. No. 09/577,275, entitled, "SNAP-IN MODULE SYSTEM", being concurrently filed herewith and having a filing date of May 23, 2000; to U.S. patent application Ser. No. 09/577,273, entitled, "BOARD MOUNTED JACK MODULE", being concurrently filed herewith and having a filing date of May 23, 2000; all of which have a common inventor and assignee and being incorporated herein by reference.

FIELD OF THE INVENTION

The present invention relates to electrical connection systems, and more particularly to electrical connections systems for use in telecommunications.

BACKGROUND OF THE INVENTION

In the telecommunications industry, connecting systems comprising an array of insulation displacement contacts (IDC) are typically used in telephone company central offices and office buildings for electrical connection between cables and cross-connect wiring. These electrical connection systems are used throughout the telecommunications industry in order to interconnect corresponding wires in two sets of wires. The predominant connecting systems for building terminal cross-connect systems are currently the modular Rj45 connector system and the 110 connection system or variations of these connection systems. The modular type connector systems use a plug and jack type interface for making connections.

The Rj45 version of a modular connector system is a 4-pair connector system that cannot be broken down to smaller increments without wasting connector positions. A patch cord connection is made to a jack by deflecting a set of cantilevered spring wires in a jack with a mating set of fixed pressure contact surfaces in the plug, as the plug is pushed into the jack with a relatively low force. As the plug completes its insertion into the jack, it automatically latches with an audible click. By gripping the exposed back end of the plug, and depressing a lever, the latch can be released. Spring loaded wire contacts within the jack essentially push the plug out. The Rj45 modular systems have a panel with a flat front face. When a patch cord is installed, the cordage comes straight out from the panel. Cross-connect distribution rings bring the cordage back in along the face of the panel.

The 110 connector system is designed with insulation displacement connections (IDC) for both the cable connections and the cross-connect or patching connections. Therefore, a patching connection can be made by terminating cross-connect wires in the contacts IDC slots, or by inserting patch cord blades into those contact shots.

This Connector System forms a connector field that is front accessible, and is designed for wall mounting. Despite this design, the 110 system can be frame mounted, with the cables fed from the front in a manner similar to wall mounting. The cables can also be fed from the back of the frame. The front access is achieved by having a cross-connect field superimposed on a cable termination field; that is, superimposed on the cable routing. Cables are routed behind the wiring blocks, either in pre-mounted channels or between the rows of wiring block support legs. Cable ends are brought through their appropriate openings in the wiring block to the cable termination surface, and the exposed cable sheath is removed. The cable conductors are fanned out as twisted pairs to their appropriate termination ports in the index strips on the front face of a wiring block. Connecting blocks, which include contacts having insulation displacement portions on two opposite ends, are brought down and snapped onto the index strip to form electrical connections between the contacts and conductors. The front surface formed by the connecting blocks is the cross-connect field. A designation strip is placed between alternate rows and is used to label the conductor terminations on the rows on either side of it. When a cross-connect field is intended for use with patch cords, 100 pair wiring blocks typically alternate with horizontal troughs, with patch cords from the upper 2 rows going into an upper trough, and patch cords from the lower 2 rows going into a lower trough. When a high percentage of patch cord positions are populated, the patch cord connectors present an unruly appearance and the labeling becomes very difficult to read, making cord location a time consuming process.

Patch cords in the 110 connector system have contact blades that make connection by inserting into the top IDC slots of the contact elements. The IDC is designed to remove conductor insulation as it makes contact, and to achieve a high enough contact force to make a stable long term connection to unplated wire. Repeated insertions of patch cord blades past this entrance geometry, with its high contact force, reduces the life of the patch cord blade's protective plating. This contact force (about 2 pounds) holds the patch cord blade by friction and prevents it from sliding out by about a third of a pound per contact. The contact slots are tapered so any vibration or wiggling of the patch cord would cause the blades to slowly walk out of the slots, unless something else held them in place.

Connecting blocks may have hemispherical buttons that match mating holes in the patch cords. By pulling on a mated patch cord, the side walls on the play end flex as they slide over the connecting blocks' buttons; a snap-on/snap-off type of latch is enabled, and the plug end is disconnected. The force to overcome this latch and remove a 4-pair patch cord, with a straight pull, can be as high as 25 pounds. Removal can be effected by a side to side rocking of the patch cord. Because patch cord plugs are in close proximity to each other, removal of one patch cord can easily result in the dislodging of a neighboring patch cord. Therefore, technicians must be very deliberate and careful during cord tracing to avoid inadvertently dislodging a patch cord. Furthermore, the high friction on the buttons can cause extensive wear of the surfaces so that the retention capability of the connecting blocks degrades after multiple insertions and removals.

SUMMARY

The electrical contacts according to the principals of the invention allow for simple, modular, and efficient patch cord connection with improved electrical performance. In an exemplary embodiment, a plug having a rotatable end and a plug contact with a blade portion is provided. A jack is provided with a corresponding rotatable end and a jack contact with a spring clip portion. By engaging the rotatable plug end with the corresponding rotatable jack end, a fulcrum is established, enabling the plug to rotate around the fulcrum point and achieve a simple and reliable connection between the blade portion and the spring clip portion. The other side of the jack contact can be an insulation displacement contact to allow connectivity to cables or the jack contact can be a printed wire board contact enabling connectivity with printed wire boards. Consequently, the hinging mechanism permits simple and reliable connections to be made while the blade and spring clip portions provide excellent connectivity and electrical performance. Engagement can be fairly insensitive to the actual direction of the blade and spring clip portions, thereby allowing connections to be made in a faster and more reliable manner.

In another exemplary embodiment, a modular jack is used with the hinged connector system for simple and efficient patch cord connection. A rotatable end structure is added adjacent to a jack cavity/engagement portion of the modular jack. This provides a complementary rotatable end structure for the plug. Moreover, the plug is provided with curved engagement surfaces that permit the modular jack to mate in an arc with the plug.

BRIEF DESCRIPTION OF THE DRAWINGS

A more complete understanding of the present invention may be obtained from consideration of the following description in conjunction with the drawing, in which.

DETAILED DESCRIPTION

Figure 1A:
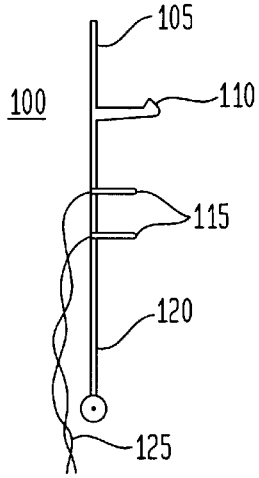
FIGS. 1(*a*)–1(*e*) are schematic diagrams of a plug and a jack in accordance with the present invention.
Figure 1B:
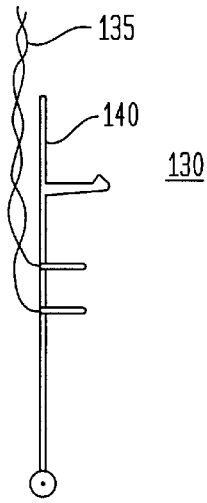
Figure 1C:
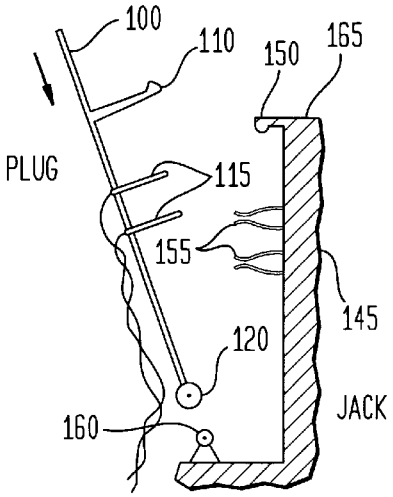
Figure 1D:
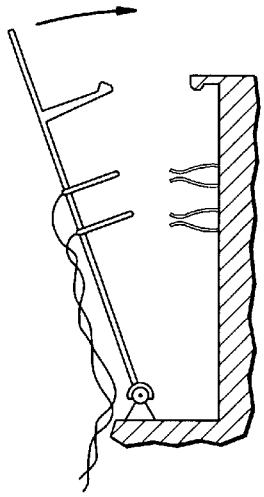
Figure 1E:
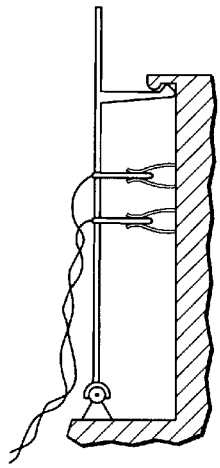

This detailed description initially discusses a cross connect system according to the principles of the invention. Exemplary embodiments for contact designs for use in a hinged connector system are then described. Finally, exemplary embodiments of the cross connect system are presented.

The Cross Connect System

A cross-connect system according to the invention makes a connection by implementing one end of a plug hooking onto a corresponding end of a jack to form a fulcrum. The plug then functions as a lever by rotating about that fulcrum until it mates with the jack.

A plug 100 is illustrated in FIG. 1(*a*). The plug 100 includes a handle 105 on one end. When the plug 100 functions as a lever, the handle 105 serves as one end of that lever. The other end of the lever is the plug fulcrum section 120. The plug 100 further includes a latch 110 that it is located proximate to the handle 105. The latch extends somewhat perpendicularly from the plug 100. A pair of contacts 115 are located between the latch 110 and the plug fulcrum section 120. Cordage 125 is electrically connected to the contacts 115. Although one pair of contacts 115 is shown in the plug 100, it is understood that any plurality of contacts can be included within the plug 100.

In one embodiment of the invention, cordage 125 exits plug 100 at plug fulcrum section 120. As such, cordage 125 is automatically directed toward a back plane (not shown) through a trough 270 as detailed in FIGS. 2 and 3(*a*)–(*c*). This keeps the immediate area clear of cordage 125, thereby providing a neat appearance and making it easier for the craftsperson to locate specific jack positions. Also, because the cordage 125 is not directed straight out, the latch engagement is unaffected when cordage 125 is manipulated, as for cord tracing, for example. Latching in this configuration can be implemented using a snap action latch mechanism.

Referring now to FIG. 1(*b*), a plug 130 can also have cordage 135 exit at a handle 140. Since cordage 135 directs away from the back plane in this instance, care must be taken to keep cordage 135 from interfering with patch cord installation or removal. A wider trough may be required, and a positive latch with a release mechanism may be required. The remaining illustrations and description employ a snap action latch; however, a positive latch with a release mechanism could also be used.

Referring now to FIGS. 1(*c*)–1(*e*), mating of plug 100 to a jack 145 is illustrated. As shown, jack 145 includes a corresponding latch 150, corresponding contacts 155 and a jack fulcrum section 160. Referring specifically to FIG. 1(*c*), plug fulcrum section 120 engages jack fulcrum section 160. The angle of engagement is sufficiently offset to prevent engagement of latch 110 with corresponding latch 150 and contacts 115 with corresponding contacts 155. Engagement of the latches and contacts is prevented until the fulcrum sections 120 and 160 are fully engaged and the plug rotated towards the jack. In one embodiment, this offset angle or rotation angle is approximately 20°. Referring now to FIGS. 1(*d*) and 1(*e*), handle 105 is used as a lever to rotate plug 100 towards jack 145 until corresponding latch and contact connection is achieved.

Figure 2:
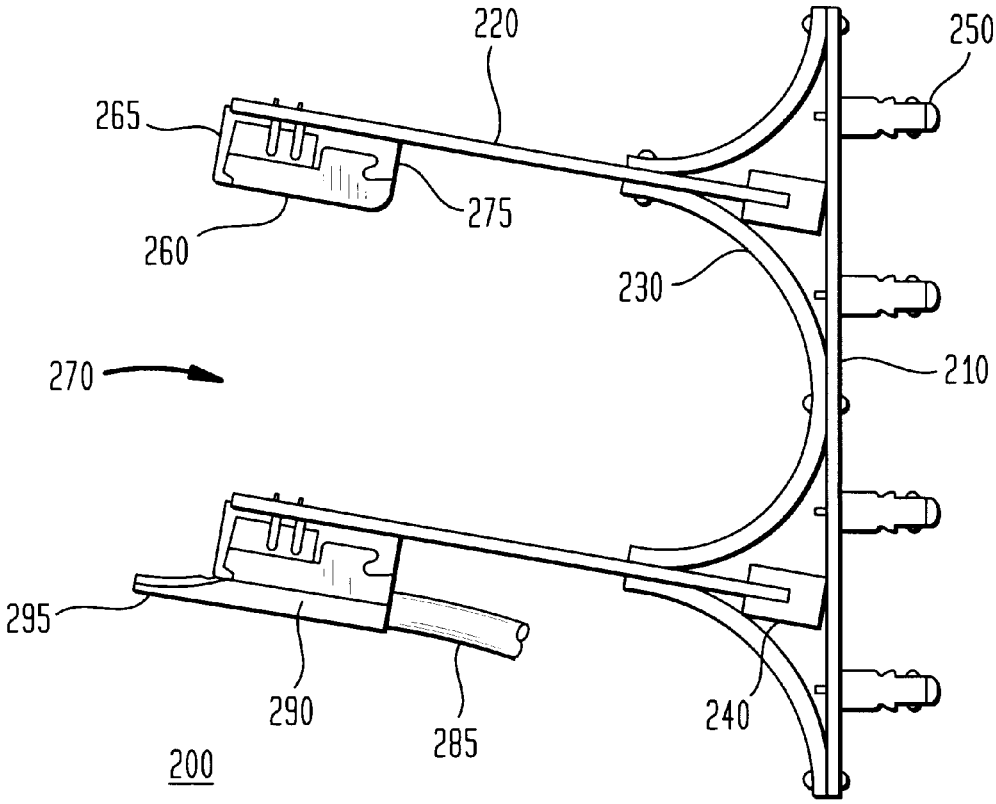
FIG. 2 is a side cross sectional view of a jack mounted on a printed wiring board support structure in accordance with the present invention.

As illustrated in FIG. 1(*c*), corresponding latch 150 further includes a label surface 165. One of the advantages of the cross connect system is that label surface 165 is positioned frontward as shown below and the resulting connection is implemented behind or below label surface 165. This implementation maximizes the area in the cross connect field that can be devoted to either the label or trough space. This advantage is shown in more detail with respect to FIGS. 2 and 3(*a*)–3(*c*). Referring to FIG. 2, a cross sectional view of a printed wiring board utilizing the cross connect system according to the principles of the invention is shown. Cross connect system 200 has a backplane printed wiring board 210 and at least one printed wiring board 220 connected to board 210 using support structures 230 and edge card connectors 240. Connection blocks 250 are attached to board 210 to permit connections with conductors of cables that go to, for example, equipment or wall jacks (not shown). Specifically, a jack 260 is connected to the board 220. Jack 260 has a label surface 265 that faces away from the board 210.

Figure 3A:
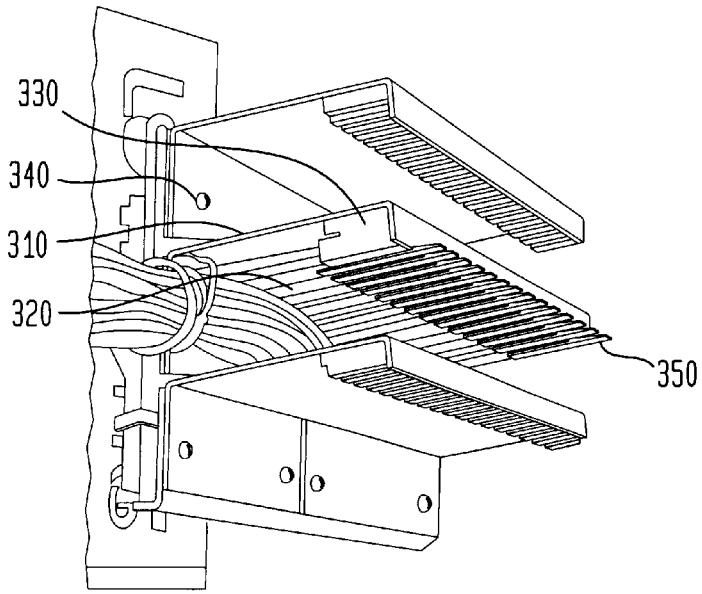
FIGS. 3(*a*)–3(*c*) show multiple perspective views of the embodiment illustrated in FIG. 2.
Figure 3B:
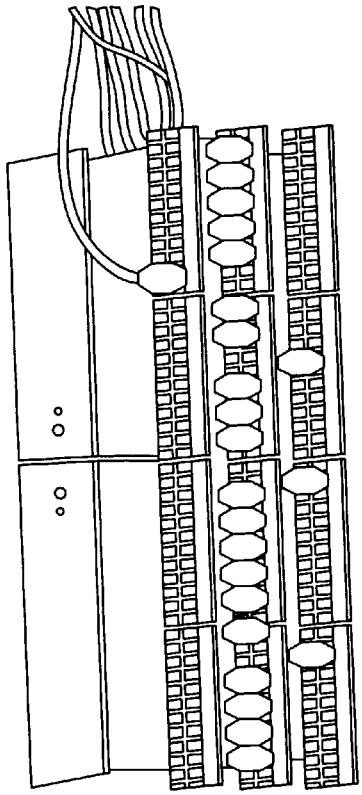
Figure 3C:
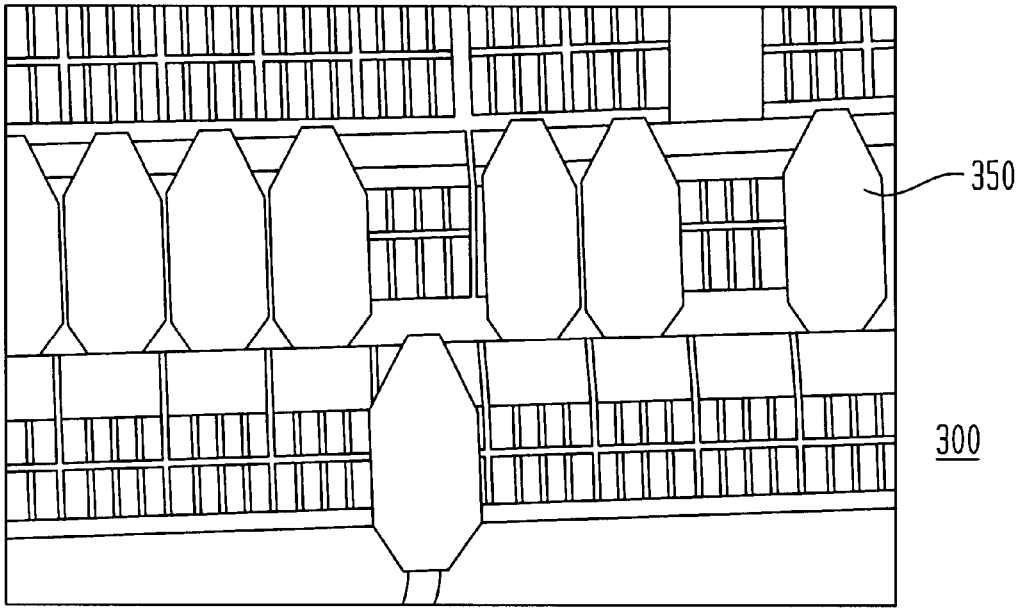

As previously shown in FIG. 1(*e*), the connection between a plug 290 and a jack 260 is made below label surface 265. If cross connection system 200 further utilizes a scheme where cordage 285 exits at a fulcrum end 275 towards board 210 and into a trough 270, then the only visible object beyond label surface 265 is the relatively small handle 275 of the plug 290. This is shown in FIGS. 3(*a*)–3(*c*). Specifically, FIG. 3(*a*) shows a perspective view of a cross connect system 300 with a mated plug and jack 310. Cordage 320 exits away from label surface 330 and into a trough area 340. FIG. 3(*b*) shows a bottom up view of FIG. 3(*a*) and FIG. 3(*c*) shows a close up view of mated plug and jack 310. FIGS. 3(*a*) and 3(*c*) show that label surface 330 is unobstructed except for the minor presence of handle 350 of mated plug and jack 310. An easy to read label surface is highly valued during cord tracing and other such activities.

Exemplary Contacts

The cross connection system according to the principles of the invention uses mateable connectors that can mate by moving along an arc of a desired radius. A preferred connector positioning would be with the axis of engagement traveling perpendicular to a radial line from the pivot point to the center of engagement travel. This minimizes relative inter-contact travel perpendicular to the engagement direction. Suitable contacts for the present invention are a blade and spring clip since they are fairly insensitive to the exact direction of engagement.

Figure 4:
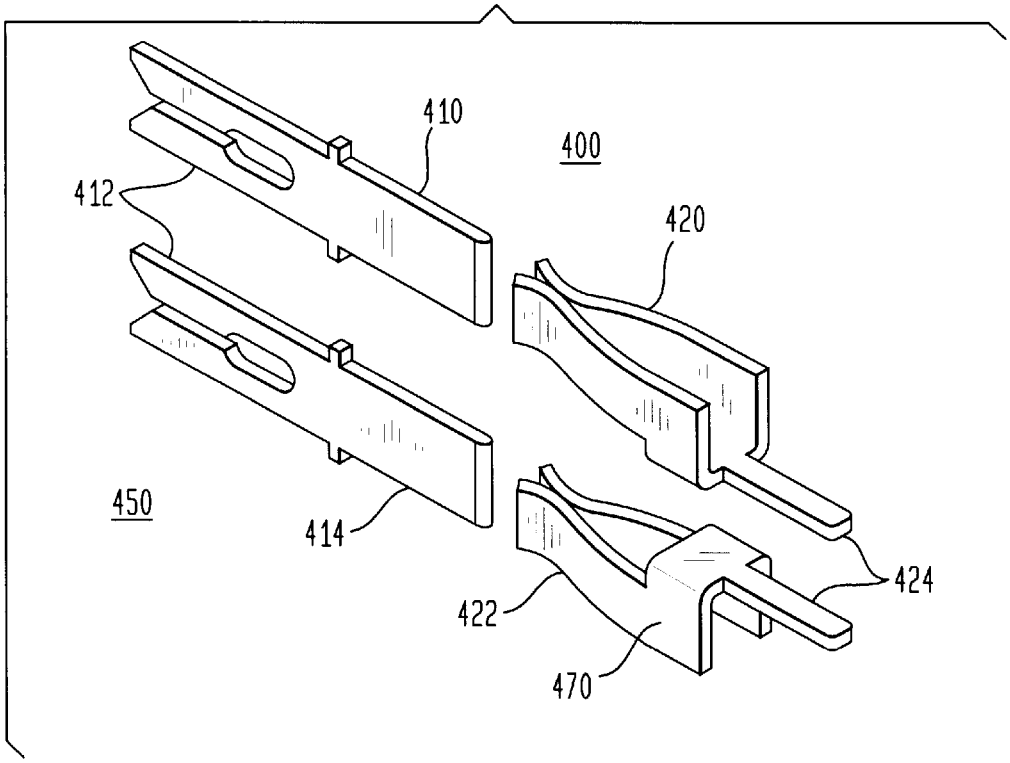
FIG. 4 is a perspective view of mateable contacts for a plug and a jack in which the jack contacts mount in, and make electrical contact to a printed wiring board, in accordance with the present invention.

Referring to FIG. 4, two pairs of mateable contacts are shown for use with a printed wired board based system in accordance with the connector system of the present invention. Contacts 400 include a plug contact 410 and a jack contact 420. Plug contact 410 further includes an insulation displacement contact 412 at one end and a blade 414 at a remaining end. Insulation displacement contact 412 is used to make contact to the cordage conductors in the plugs. Blade 414 is radially aligned. Jack contact 420 further includes a spring clip 422 at one end and a printed wired board contact 424 at a remaining end. Contacts 450 are similar to contacts 400 except that jack contacts 460 are structurally inverted with respect to jack contacts 420.

Figure 5:
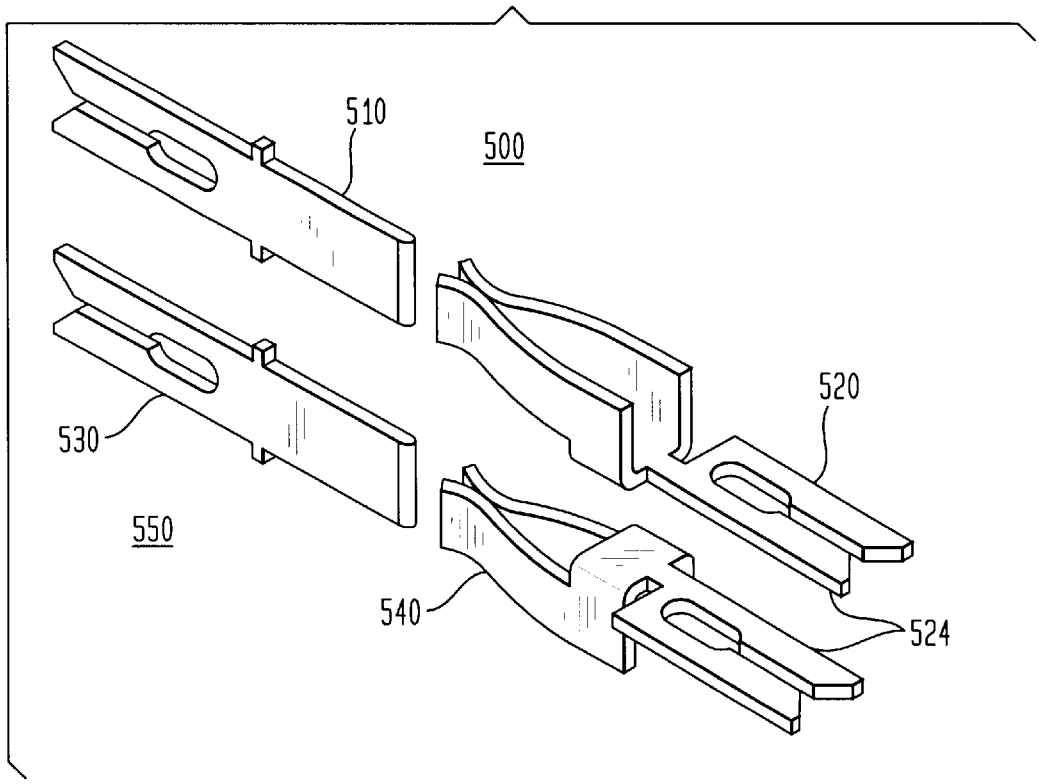
FIG. 5 are perspective views of mateable contacts for a plug and a jack where both the plug and jack contacts have JDC's to make connection to wire conductors, in accordance with the present invention.

Referring to FIG. 5, two pairs of exemplary mateable contacts are shown. Contacts 500 and 550 include plug contacts 510 and 530 as described above, respectively. Contacts 500 include a jack contact 520 that has a spring clip 522 at one end and an insulation displacement contact 524 at a remaining end. Insulation displacement contact 524 is connected offset or staggered with respect to the radial center of jack contact 520. As before, jack contact 570 of contacts 550 is structurally inverted with respect to jack contacts 500.

In another exemplary embodiment, the contacts are provided such that a modular jack and plug system can mate on an arc. Conventional modular jacks generally comprise a one-piece plastic housing having a longitudinal cavity adapted to receive the modular plug. Associated with the housing are jack contacts adapted to engage the contacts of the plug when the latter is inserted into the jack cavity or receptacle. The contacts in current modular systems are constrained to a regulated interconnect system that must conform to geometrical constraints. These constraints prevent the use of these type of contacts in a hinged system, at least one with a small radius. Specifically, the guide surfaces in current modular systems are used for aligning the plug to an essentially straight line engagement with and into the jack.

Figure 6:
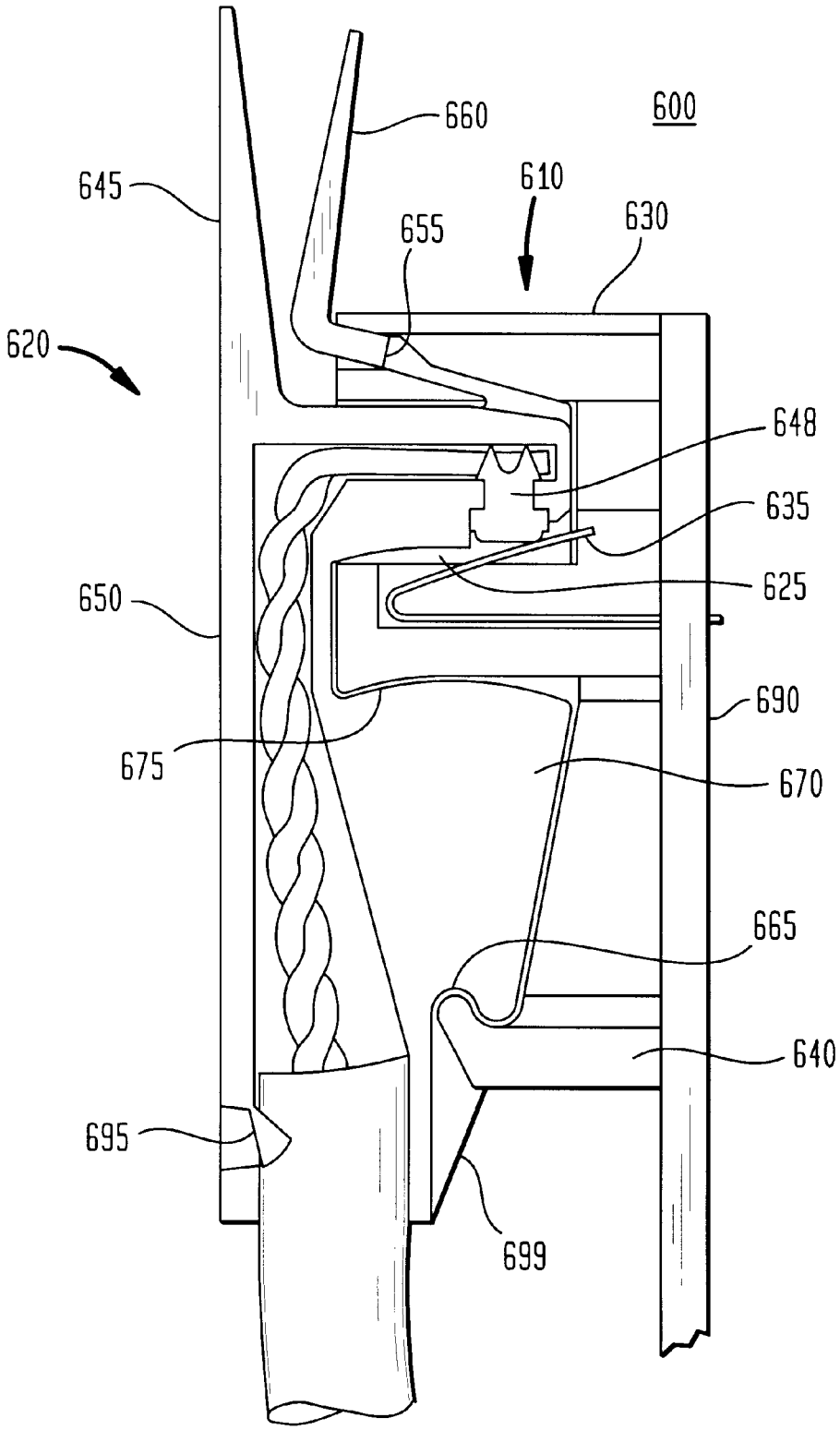
FIG. 6 is a cross-sectional side view of another mated plug and jack similar to the Rj45 concept, in accordance with the present invention.

Referring to FIG. 6, an exemplary embodiment of a cross connect system 600 is shown using concepts of a modular system. Cross connect system 600 includes a jack 610 and a plug 620. Jack 610 includes a jack cavity 625 similar to those in current modular systems. Unlike current modular systems, however, jack cavity 625 now faces downward. This architecture permits jack 610 to be connected with a standard plug or plug 620. Jack 610 also includes a label surface 630. As shown below, all connections are made below label surface 630. As such, label surface 630 is visible when performing maintenance or other work on the system. Jack 610 further includes a hinge bearing hook 640 for rotatably connecting with plug 620. Hinge bearing hook 640 can be integrally incorporated into the jack housing of jack 610 or be mounted as a separate piece. Jack 610 also includes jack contacts 635, which are situated internally with respect to jack cavity 625 and can be connected to, for example, a printed wire board 690. The board 690 acts as a support structure for the jack 610. The jack 610 can also be configured as a self-contained module or a snap in jack, with its own integral conductor termination ports.

The plug 620 includes a handle 645, cord straining mechanism, for example, latch 695, plug contacts 648 and a plug engagement portion 650. Plug engagement portion in the jack and the corresponding engagement surfaces on the plug are curved to facilitate plug 620 mating in an arc with jack 610. The plug engagement portion 650 of the jack 610 is the cavity that the plug 620 goes into. Plug 620 further includes a latch 655. A right angle extension 660 is attached to latch 655 to make it easier to release latch 655 when plug 620 is mated with jack 610. Moreover, plug 620 has been incorporated with a hinge to mate plug body that includes a plug bearing hook 665 and anti-snag detail 670. The anti-snag detail 670 further includes guide surface 675 which keeps plug bearing hook 665 and hinge bearing hook 640 fully engaged after the rotation starts. The anti-snag rib 699 further prevents the portion of the plug that goes into the jack from snagging on other cords when it is pulled through a trough.

Figure 7A:
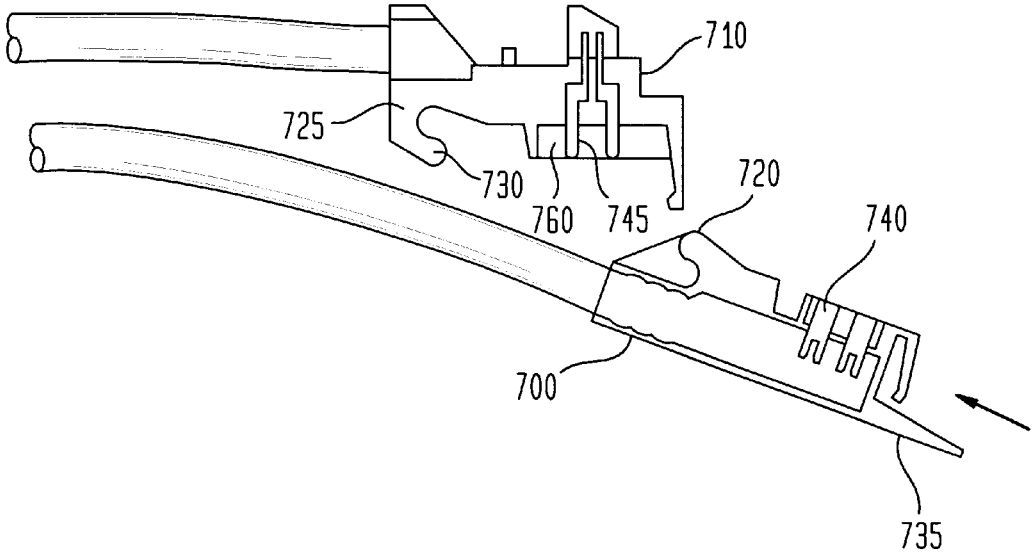
FIGS. 7(*a*)–7(*c*) illustrate, from a cross-sectional perspective, the connecting of a plug to a jack module in accordance with the present invention.
Figure 7B:
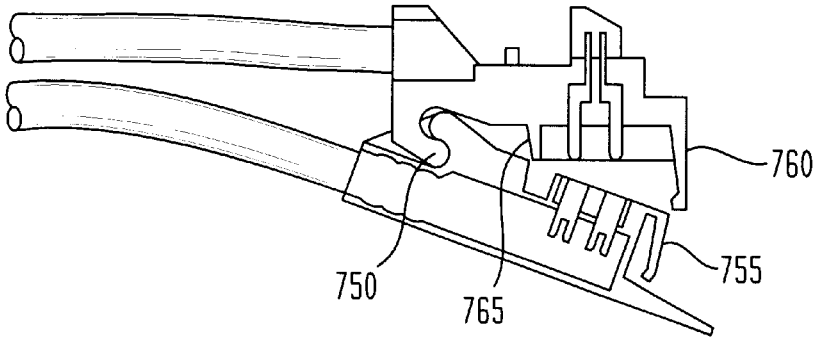
Figure 7C:
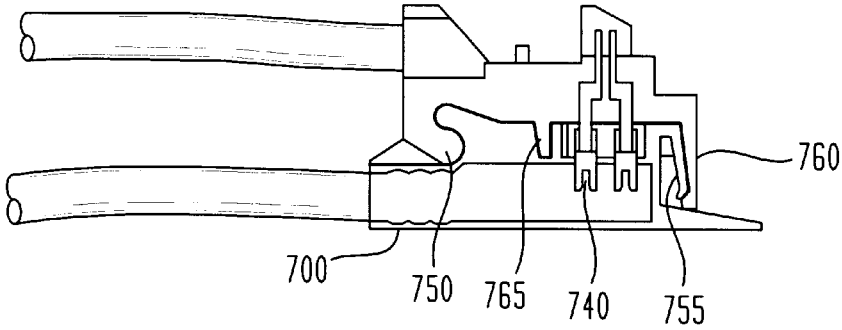

Referring now to FIGS. 7(*a*) to 7(*c*), a patch cord or plug 700 is mated with a jack 710 in accordance with the principles of the invention. The following operational description is accurate for any jack and plug utilizing the concepts of the present invention. A plug bearing hook 720 is hooked onto a hinge bearing surface 730, formed by hinge bearing hook 725. Plug 700 is then rotated into its seated position by using handle 735 as a lever to force plug contacts 740 to mate with jack contacts 745.

Figure 8A:
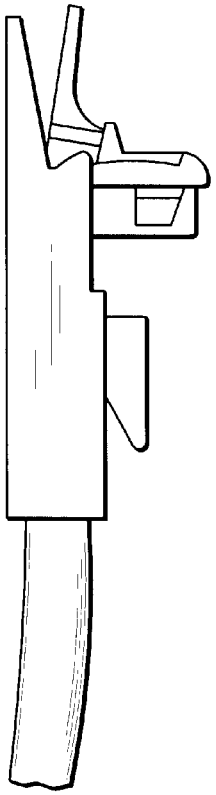
FIGS. 8(*a*) and 8(*b*) are side views of the connecting of a plug and jack similar to the Rj45 concept, in accordance with the present invention.
Figure 8B:
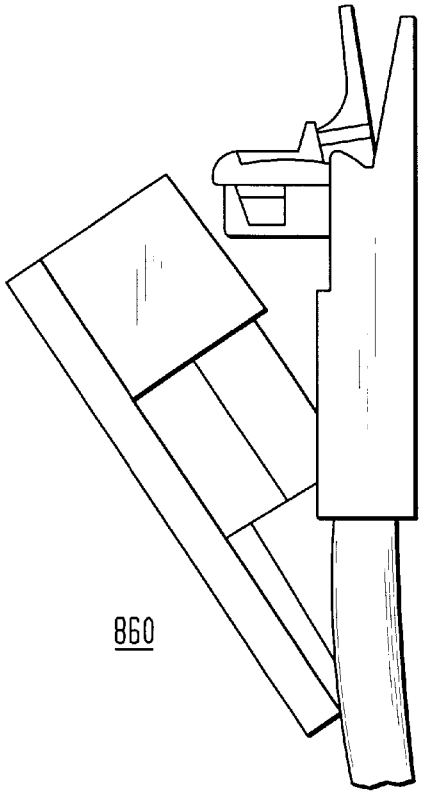

Specifically, as plug 700 rotates about fulcrum point 750 toward jack 710, plug spring latch 755 engages a latch 760 in the plug 710, and snaps into place. Referring also to FIG. 8, guide surfaces can be seen that control the rotation path so that the contacts mate in a precise manner. Specifically, plug 700 engages the side guide surfaces 860 before plug 700 fully engages hinge bearing hook 730. After hinge bearing hook 730 is engaged, jack 710 starts to rotate about hinge bearing hook 730, but before there is any contact engagement, plug 700 engages the bearing housing 765 which serves as a third guide surface, insuring that jack 710 remains fully seated onto hinge bearing hook 730, as plug 700 completes its rotation.

The side guide surfaces 760 extend beyond the hinge bearing hook 730 as well as the jack contacts 745. Thus, when the plug contacts 740 are mated with the jack contacts 745, the connections are completed below the outer edges of the side guide surfaces 760. This protects the contacts for both the plug 700 and the jack 710. Because the side guide surfaces 760 are separated in distance to accommodate the width of the plug 700, the side guide surfaces also provide lateral support, holding plug 700 firmly in place. Therefore manipulating the patch cord's cordage has very little effect on the security of the connection. Pushing on handle 735 is the practical way to disengage a patch cord. The patch cord can be disengaged if the point where the cordage enters the plug is pushed in fairly hard. This would require several pounds since the mechanical advantage is working against it.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that come within the scope of the appended claim is reserved.

What is claimed is:

1. A connector system for telecommunications electrical connections, said system comprising:

a base structure, a support structure having a rear portion and a front portion, said rear portion of said support structure being attached to said base structure, a jack affixed to said front portion of said support structure, said jack having a front end positioned near said front portion of said support structure and a rear end extending toward said rear portion of said support structure, said jack having a latch receptacle located near said front end and a pivot connection located near said rear end; said jack further having a jack contact having a spring clip portion at said front end;

a plug having a pivot end and a latch end, said plug having a plug contact at the pivot end having a blade portion at one end and an insulation displacement contact at an opposite end, said plug adapted to be affixed to said jack by means of first establishing a fulcrum point common to said jack and said plug by engaging said pivot end with said pivot connection of said jack, and said plug being rotated about said fulcrum point until an electrical connection is made between said blade portion of said plug and said spring clip portion of said jack contact of said jack and wherein the latch end of said plug mechanically latches with said latch receptacle of said jack.

2. The connector system according to claim 1, wherein said jack contact includes an insulation displacement contact at an opposite end.

3. The connector system according to claim 2, wherein said insulation displacement contact is connected staggered with respect to a radial center of said jack contact.

4. The connector system according to claim 1, wherein said jack contact includes a printed wire board contact at an opposite end.

5. The connector system according to claim 1, said plug further comprising a handle at a remaining end, said handle rotating said plug into said jack.

6. The connector system according to claim 1, wherein said jack includes a hinge bearing hook integrated into said jack.

7. The connector system according to claim 1, said jack further comprising a label surface, wherein said electrical connection is made below said label surface.

8. The connector system according to claim 1, said jack further comprising a top wall and a back wall the forms a jack cavity.

9. The connector system according to claim 8, wherein said back wall includes a front surface and a back surface, said back surface having a concave curvature.

10. The connector system according to claim 1, said jack further comprising:

a first guide surface; and a second guide surface, wherein said first guide surface and said second guide surface guide said plug into said jack.

11. The connector system according to claim 10, said jack further comprising a third guide surface to maintain said fulcrum point as said plug is rotated about said fulcrum point.

12. A connector system for telecommunications electrical connections, said system comprising:

a base structure, a support structure having a rear portion and a front portion, said rear portion of said support structure being attached to said base structure, a jack affixed to said front portion of said support structure, said jack having a front end positioned near said front portion of said support structure and a rear end extending toward said rear portion of said support structure, said jack having a latch receptacle located near said front end and a pivot connection located near said rear end; said pivot connection adapted to form a common pivot point with a plug to enable a plug to be rotated about said pivot point to be retained by said latch receptacle forming an electrical connection therebetween, said jack further having a jack contact having a spring clip portion at said front end to receive a blade contact on a plug to form the electrical connection therebetween.

13. The connector system according to claim 12, wherein said jack contact includes an insulation displacement contact at an opposite end.

14. The connector system according to claim 13, wherein said insulation displacement contact is connected staggered with respect to a radial center of said jack contact.

15. The connector system according to claim 12, wherein said jack contact includes a printed wire board contact at an opposite end.

* * * * *